US006063256A

United States Patent [19]

Pütter et al.

[11] Patent Number: 6,063,256

[45] Date of Patent: May 16, 2000

[54] PREPARATION OF PHTHALIDES

[75] Inventors: Hermann Pütter, Neustadt; Heinz Hannebaum, Ludwigshafen, both of Germany

[73] Assignee: BASF Aktiengesellschaft, Ludwigshafen, Germany

[21] Appl. No.: 09/125,019

[22] PCT Filed: Apr. 28, 1997

[86] PCT No.: PCT/EP97/02185

§ 371 Date: Aug. 10, 1998

§ 102(e) Date: Aug. 10, 1998

[87] PCT Pub. No.: WO97/43464

PCT Pub. Date: Nov. 20, 1997

[30] Foreign Application Priority Data

May 10, 1996 [DE] Germany ..... 196 18 854

[51] Int. Cl.[7] ..... C25B 3/00; C07C 69/76; C07C 307/77; C07D 305/12

[52] U.S. Cl. ..... 205/440; 205/427; 560/76; 549/234; 549/307

[58] Field of Search ..... 205/427, 440; 560/76; 549/234, 307

[56] References Cited

FOREIGN PATENT DOCUMENTS

| | | |
|---|---|---|
| 2357662 | 3/1978 | France . |
| 2144419 | 7/1976 | Germany . |
| 2510920 | 9/1976 | Germany . |

*Primary Examiner*—Kathryn Gorgos
*Assistant Examiner*—Edna Wong
*Attorney, Agent, or Firm*—Oblon, Spivak, McClelland, Maier & Neustadt, P.C.

[57] ABSTRACT

A process is disclosed for preparing phthalides by cathodic reduction of phthalic acid or phthalic acid derivatives, in which the carboxylic acid units may be substituted by units which can be derived by a condensation reaction from carboxylic acid units and in which one or several hydrogen atoms of the o-phenylene unit of the phthalic acid may be substituted by inert radicals. This process is characterised in that the reduction is carried out in an organic solvent which contains less than 50 wt % water and in a non-divided electrolytic cell.

17 Claims, No Drawings

PREPARATION OF PHTHALIDES

This is a national stage application of PCT/EP97/02185, filed Apr. 28, 1997.

The present invention relates to a novel process for preparing phthalides by cathodic reduction of phthalic acid derivatives.

Phthalides are required in particular as intermediates for the synthesis of crop protection agents.

DE-A-2 144 419 discloses an electrochemical process for preparing phthalides by cathodic reduction of ammonium phthalamate in an aqueous solution containing up to 50% of organic solvents at temperatures of up to 65° C. on metals having a hydrogen overpotential greater than Cu, for example lead. Under these conditions, the preparation of phthalides is achieved in satisfactory yields if the reduction is carried out in divided electrolytic cells.

The preparation of particularly pure phthalides is described in DE-A-2 510 920. This publication teaches the cathodic reduction of ammoniacal, aqueous solutions of phthalic acid or phthalic anhydride at temperatures of up to 100° C. over metals having a hydrogen overpotential greater than Cu. Again, the process requires the use of divided electrolytic cells. The phthalide is separated off from the electrolytic mixture by acidifying at from 35 to 100° C., if necessary after removal of excess ammonia, and separating off the precipitated phthalide.

The processes described, however, have the disadvantage of the high expenditure on equipment involved with the use of divided electrolytic cells, since 2 cell circuits are required in this case. Furthermore, working with 2 cell circuits has the following further disadvantages:

The cell circuits have to be separated by a membrane or a diaphragm; this means an energy loss owing to heat of resistance. Usually, in order to minimize this loss, at least one chamber is charged with an aqueous (>80% $H_2O$) solution of supporting electrolytes. In cathodic reductions, this is the anolyte. This considerably reduces the available options for exploiting the anodic reaction. Normally, the sole anodic product formed is hydrogen.

In addition, with the processes known hitherto there is a danger that anode corrosion and a poisoning of the cathodes may occur.

It is an object of the present invention to provide a technically simple process for preparing phthalides of high purity and in good yields without the disadvantages of the state of the art and which, in particular, opens up the possibility of exploiting the anode reaction for the preparation of products other than hydrogen.

We have found that this object is achieved by a process for preparing phthalides by cathodic reduction of phthalic acid or phthalic acid derivatives in which the carboxyl groups may be replaced by units which can be derived from carboxyl groups by a condensation reaction and one or more of the hydrogens of the o-phenylene unit of the phthalic acid may be replaced by inert radicals, which comprises carrying out the reduction in an organic solvent containing less than 50% by weight of water in an undivided electrolytic cell.

Starting materials employed for preparing the phthalides are in particular those of the general formula I

I

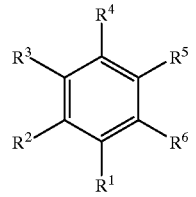

where the substituents have the following meanings:

$R^1$, $R^2$, $R^3$ and $R^4$: are each, independently of one another, hydrogen, $C_1$- to $C_4$-alkyl or halogen $R^5$, $R^6$:

a) are each, independently of one another, —COOH or COOX, where X is $C_1$- to $C_4$-alkyl, b) one of the substituents $R^5$ or $R^6$ is —$COONY_4$ and the other substituent is $CONH_2$, where Y is $C_1$- to $C_4$-alkyl or hydrogen, c) $R^5$ and $R^6$ are together —CO—O—CO—.

Especially preferred are the derivatives of phthalic acid where $R_1$, $R_2$, $R_3$ and $R_4$ are each hydrogen, and amongst those in particular di($C_1$- to $C_3$-alkyl) phthalates, especially dimethyl phthalate.

In the compounds of the formula I where $R^5$ and $R^6$ are as defined under b), the ammonium salts, and in particular the ammonium salt of phthalamic acid, are particularly preferred.

Suitable electrode materials (for cathode and anode) are in particular commercially available electrodes made of graphite or carbon.

The electrolyte is usually a 2 to 40% by weight strength solution of phthalic acid or a phthalic acid derivative in an organic solvent preferably containing less than 25, especially preferably less than 5, % by weight of water.

Useful organic solvents are in particular aliphatic $C_1$- to $C_4$-alcohols, in particular methanol or ethanol, or a mixture of said alcohols with a carboxamide such as dimethylformamide or t-butylformamide.

Suitable supporting electrolytes contained in the electrolytes are generally alkyl sulfates, for example methyl sulfate, or quaternary ammonium salts, in particular tetra($C_1$- to $C_4$-alkyl)ammonium halides or tetrafluoroborates, usually in amounts of from 0.4 to 10% by weight based on the electrolyte.

For the anodic coproduction process, it is advisable to use conventional organic compounds whose suitability for use as anodic depolarizers in electrochemical oxidation is generally known to the person skilled in the art. Some of the anodic coproduction processes are preferably carried out in the presence of a mediator. Possible anodic coproduction processes and their mediation are for example described in D. Kyriakou, Modern Electroorganic Chemistry, Springer, Berlin 1994, Chapter 4.2.

Useful anodic coproduction processes are in particular the oxidation of C—O or C—N single or double bonds, for example the oxidation of carboxylic acids, arylmethanes, aldehydes, carboxamides, alcohols and heterocycles, or the oxidative C—C coupling in particular of naphthalenes or activated CH groups.

Useful mediators are in particular halogen compounds, especially bromides or iodides.

The other process parameters such as temperature and current density are not crucial as long as they are kept within the conventional limits for electrochemical reactions of organic compounds. They are further specified for example in The way in which the electrolyte mixture is worked up depends in particular on the nature of the anodic coproduct and can be carried out by generally known separation methods such as distillation, precipitation or recrystallization. A particularly easy way to separate most phthalides from many organic byproducts insoluble in basic aqueous media comprises dissolving the phthalides in ammoniacal aqueous solutions, separating off the aqueous phase and re-precipitating the phthalide from the aqueous phase by acidification (again cf. DE-A-2 510 920).

The process according to the invention affords phthalides in a technically simple manner in high yields and purity. At the same time, it is possible to prepare various products of value by coproduction with anodic oxidation reactions without reducing current yield and material yield at the cathode.

EXAMPLE 1

Exclusive production of phthalide as product of value

A solution of 500 g of dimethyl phthalate (2.56 mol), 1600 g of t-butylformamide and 375 g of methanol together with 25 g of tetrabutylammonium tetrafluoroborate are subjected to electrolysis in an electrolytic cell comprising ten annular graphite discs (surface per side: 147 $dm^2$) in a bipolar arrangement, having a distance between the electrodes of 0.7 mm, at a current of 2.5 A at 60° C. for 11.5 h.

After distilling off the solvent mixture, distillation under reduced pressure at 10 mbar gave 2.18 mol of phthalide, equivalent to 85%.

The t-butylformamide solvent is recovered undecomposed, the anodic process is the oxidation of methanol with methyl formate as the main product.

EXAMPLE 2

Coproduction of phthalide and N-methoxymethyl-N-methylformamide

In an electrolytic cell as used in Example 1, 2.56 mol of dimethyl phthalate, 750 g of methanol, 1225 g of dimethylformamide (DMF) and 25 g of triethylmethylammonium methosulfate were subjected to electrolysis at 5 A and 50° C. for 6.9 h. 4.1 mol (current yield: 64%) of N-methoxymethyl-N-methylformamide were formed besides 2.1 mol of phthalide (material yield: 82%).

EXAMPLES 3 to 9

In a manner similar to Example 2, phthalide and various anodic coproducts were prepared using the starting materials stated in Table 1 for each case.

We claim:

1. A process for preparing phthalides by cathodic reduction of phthalic acid derivatives in which the carboxyl groups may be replaced by units which can be derived from carboxyl groups by a condensation reaction and one or more of the hydrogens of the o-phenylene unit of the phthalic acid may be replaced by inert radicals, which comprises carrying out the reduction in an organic solvent containing less than 50% by weight of water in an undivided electrolytic cell, and wherein said phthalic acid derivatives are di($C_1$- to $C_3$-alkyl) phthalates.

2. A process as claimed in claim 1, wherein phthalic acid derivatives of the general formula I

I

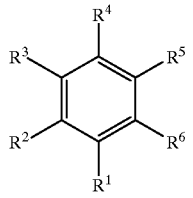

are employed where the substituents have the following meanings:

$R^1$, $R^2$, $R^3$ and $R^4$: are each, independently of one another, hydrogen, $C_1$- to $C_4$-alkyl or halogen $R^5$, $R^6$:

a) are each, independently of one another, COOX, where X is $C_1$- to $C_3$-alkyl.

3. A process as claimed in any of claim 1, wherein the organic solvent used is an aliphatic $C_1$- to $C_4$-alcohol or a mixture of such an alcohol with a carboxamide.

4. The process as claimed in claim 1, wherein the organic solvent farther comprises a quaternary ammonium salt.

5. The process of claim 1, wherein the electrolytic cell comprises an anode, and at the anode, an anodic coproduction process is carried out in which a conventional organic compound suitable for electrochemical oxidation is oxidized.

6. The process of claim 5, wherein the anodic coproduction process is conducted in the presence of a mediator.

7. The process of claim 6, wherein the mediator is a halogen compound.

8. The process of claim 7, wherein the halogen compound is a bromide or an iodide.

9. A process for preparing phthalides by cathodic reduction of phthalic acid or phthalic acid derivatives in which the

TABLE 1

| Ex. | Cosolvent[1)] | Supporting electrolyte | anodic depolarizer | Yield of phthalide | Anodic product |
|---|---|---|---|---|---|
| 3 | $H_2O$ (3%) | Tetrabutylammonium iodide | Cyclohexanone | 80% | 2,2'-Dimethoxycyclohexanol |
| 4 | | Tetraethylammonium bromide | Furan | 92% | 2,5-Dimethoxydihydrofuran |
| 5 | DMF (2%) | Tetrabutylammonium tetrafluoroborate | p-Xylene | 85% | Tolylaldehyde dimethyl acetal |
| 6 | DMF (20%) | Tetrabutylammonium tetrafluoroborate | t-Butyl-toluene | 90% | t-Butylbenzaldehyde dimethyl acetal |
| 7 | Dimethoxy-methane | Tetraethylammonium bromide | Methanol | 89% | Mainly methyl formate |
| 8 | DMF (1%) | Tetraethylammonium bromide | Methanol | 85% | Mainly methyl formate |
| 9 | Water (10%) | Tetraethylammonium bromide | Hydroxypival-aldehyde | 84% | Methyl hydroxypivalate |

[1)]% by weight based on methanol carboxyl groups may be replaced by units which can be derived from carboxyl groups by a condensation reaction and one or more of the hydrogens of the o-phenylene unit of the phthalic acid may be replaced by inert radicals, which comprises carrying out the reduction in an organic solvent containing less than 50% by weight of water in an undivided electrolytic cell wherein graphite or carbon electrodes are used.

10. The process as claimed in claim 9, wherein phthalic acid or phthalic acid derivatives of the general formula I

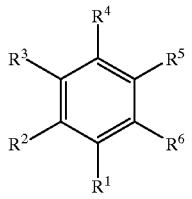

are employed where the substituents have the following meanings:

$R^1$, $R^2$, $R^3$ and $R^4$: are each, independently of one another, hydrogen, $C_1$- to $C_4$-alkyl or halogen $R^5$, $R^6$:

a) are each, independently of one another, —COOH or COOX, where X is $C_1$- to $C_4$-alkyl, b) one of the substituents $R^5$ or $R^6$ is —$COONY_4$ and the other substituent is $CONH_2$, where Y is $C_1$- to $C_4$-alkyl or hydrogen, c) $R^5$ and $R^6$ are together —CO—O—CO.

11. The process as claimed in claim 9, wherein the phthalic acid derivatives used are di($C_1$- to $C_3$-alkyl) phthalates.

12. The process as claimed in claim 9, wherein the organic solvent used is an alkphatic $C_1$- to $C_4$-alcohol or a mixture of such an alcohol with a carboxamide.

13. The process as claimed in claim 9, wherein the organic solvent further comprises a quaternary ammonium salt.

14. The process of claim 9, wherein the electrolytic cell comprises an anode, and at the anode, an anodic coproduction process is carried out in which a conventional organic compound suitable for electrochemical oxidation is oxidized.

15. The process of claim 14, wherein the anodic coproduction process is conducted in the presence of a mediator.

16. The process of claim 15, wherein the mediator is a halogen compound.

17. The process of claim 16, wherein the halogen compound is a bromide or an iodide.

* * * * *